US010384905B2

(12) United States Patent
Iwamoto

(10) Patent No.: US 10,384,905 B2
(45) Date of Patent: Aug. 20, 2019

(54) CUTTING DEVICE AND LABEL PRINTER

(71) Applicant: TOSHIBA TEC KABUSHIKI KAISHA, Tokyo (JP)

(72) Inventor: Jun Iwamoto, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/033,609

(22) Filed: Jul. 12, 2018

(65) Prior Publication Data

US 2019/0023517 A1 Jan. 24, 2019

(30) Foreign Application Priority Data

Jul. 21, 2017 (JP) ..... 2017-141487

(51) Int. Cl.

| | |
|---|---|
| ***B41J 11/66*** | (2006.01) |
| ***B41J 11/70*** | (2006.01) |
| ***B65H 35/00*** | (2006.01) |
| ***B41J 2/32*** | (2006.01) |
| ***B41J 3/407*** | (2006.01) |
| ***B26D 7/27*** | (2006.01) |

(52) U.S. Cl.

CPC ..... *B65H 35/0086* (2013.01); *B26D 7/27* (2013.01); *B41J 2/32* (2013.01); *B41J 3/4075* (2013.01); *B41J 11/66* (2013.01); *B41J 11/703* (2013.01); *B65H 35/002* (2013.01)

(58) Field of Classification Search

CPC .... B65H 35/0086; B65H 35/002; B26D 7/27; B41J 11/703; B41J 2/32; B41J 11/66; B41J 3/4075

See application file for complete search history.

(56) References Cited

U.S. PATENT DOCUMENTS 6,145,561 A * 11/2000 Watanabe ..... B26D 1/0006 156/517

FOREIGN PATENT DOCUMENTS

JP 2015-62986 A 4/2015

OTHER PUBLICATIONS

Google translation of JP 2015-062986, published on Apr. 2015 (Year: 2015).*

* cited by examiner

*Primary Examiner* — Huan H Tran
(74) *Attorney, Agent, or Firm* — Kim & Stewart LLP

(57) ABSTRACT

A cutting device includes a fixed blade and a movable blade that slides past the fixed blade during cutting, and a cleaning tool with an adhesive removing element that comes into contact with a surface of the movable blade that faces the fixed blade during the cutting.

20 Claims, 7 Drawing Sheets

CUTTING DEVICE AND LABEL PRINTER

CROSS-REFERENCE TO RELATED APPLICATION

This application is based upon and claims the benefit of priority from Japanese Patent Application No. 2017-141487, filed Jul. 21, 2017, the entire contents of which are incorporated herein by reference.

FIELD

Embodiments described herein relate generally to a cutting device and a label printer.

BACKGROUND

In the related art, a label printer that prints desired information on a linerless label (label without a mount) is used. The linerless label has, for example, an adhesive material on a pasting surface, that is, a rear surface of a print surface, and is wound in a roll shape.

In the label printer, the linerless label after printing is cut to a predetermined length by a cutting device, and the cut label is attached to an object such as a commodity. In such a label printer, when the linerless label is cut by the cutting device, if remnants of the adhesive material adheres to blades of the cutting device, the blades stick together, and electric power necessary for moving the blades during subsequent cutting is increased.

For this reason, the cutting device of the linerless label is configured so that the adhesive material adheres less thereto than the cutting device of an ordinary thermal printer. However, since it is not possible to completely prevent adhesion of the adhesive material, there has been a need, for example, to manually clean the blade every predetermined time interval and to remove the adhesive material.

Cleaning of such a blade is carried out using a cotton swab or the like, but there are cases where the adhesive material remains or it is difficult to remove the adhesive material.

DETAILED DESCRIPTION

Embodiments provide a cutting device and a label printer in which a cutting blade can be easily cleaned and thus suppress an increase in electric power used for cutting.

In general, according to one embodiment, there is provided a cutting device including a fixed blade and a movable blade that that slides past the fixed blade during cutting, and a cleaning tool with an adhesive removing element that comes into contact with a surface of the movable blade that faces the fixed blade during the cutting.

Hereinafter, a cutting device 10 according to the exemplary embodiment and a label printer 100 including a cutting device 10 will be described with reference to the accompanying drawings.

First Embodiment

Figure 1:
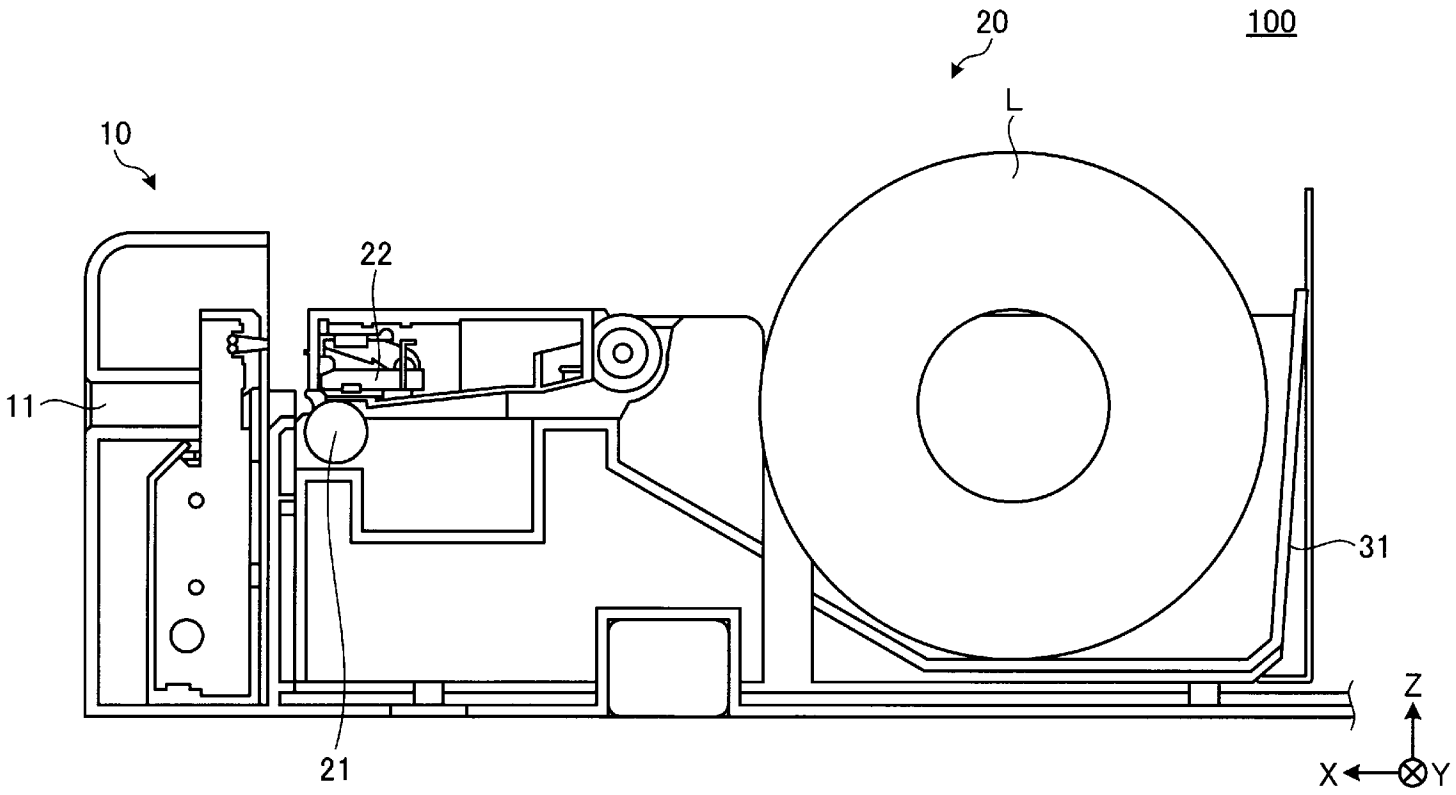
FIG. 1 is a schematic diagram of a label printer according to a first embodiment.

FIG. 1 is a schematic diagram of a label printer in a first embodiment. The label printer 100 is provided with a printing device 20 and the cutting device 10. The cutting device 10 may be integrated with the printing device 20 to configure the label printer 100, or may be configured to be detachable from the label printer 100.

In the label printer 100, the printing device 20 prints desired information (e.g., label information) on a linerless label L while transporting the linerless label L, the cutting device 10 cuts off a portion of linerless label L on which the desired information is printed, and discharges the portion of the linerless label L which is cut off from a discharge port 11. In the present embodiment, as illustrated in FIG. 1, a direction toward the discharge port 11 on a downstream side of the label printer 100 is referred to as X axis, a direction along the discharge port 11 of the label printer 100 is referred to Y axis, and a direction from a bottom surface toward the upper surface of the label printer 100 is referred to as Z axis.

First, the printing device 20 will be described. The printing device 20 is provided with a storage portion 31, a thermal head 22, and a platen roller 21.

The storage portion 31 stores a roll that the linerless label L is wound in a rotatable state. The linerless label L used in the present embodiment is an example of a pastable member, and is a label paper without a liner. Accordingly, the roll is wound in a state where a surface to be pasted (one example of one surface), which is the rear side of the linerless label L having the adhesive material, is in close contact with the print surface of the linerless label L. When printing desired information on the linerless label L, one end of the linerless label L is pulled by the rotation of the platen roller 21, which will be described later, and the linerless label L is drawn out from the roll.

In the label printer 100 according to the present embodiment, in a case where a roll that the linerless label L is wound is stored in the storage portion 31, a so-called drop-in system that stores the roll by being thrown in from above is adopted, for example.

The thermal head 22 is brought into close contact with the platen roller 21 serving as a transport unit of the linerless label L, and performs printing on the linerless label L on desired information (e.g., label information). The platen roller 21 rotates as a driving force of a stepping motor or the like is transmitted to transport the linerless label L sandwiched between the platen roller 21 and the thermal head 22. The linerless label L is drawn out from the storage portion 31 being the upstream side and transported to the discharge port 11 being the downstream side of the cutting device 10 in a transport direction in the label printer 100.

Figure 2:
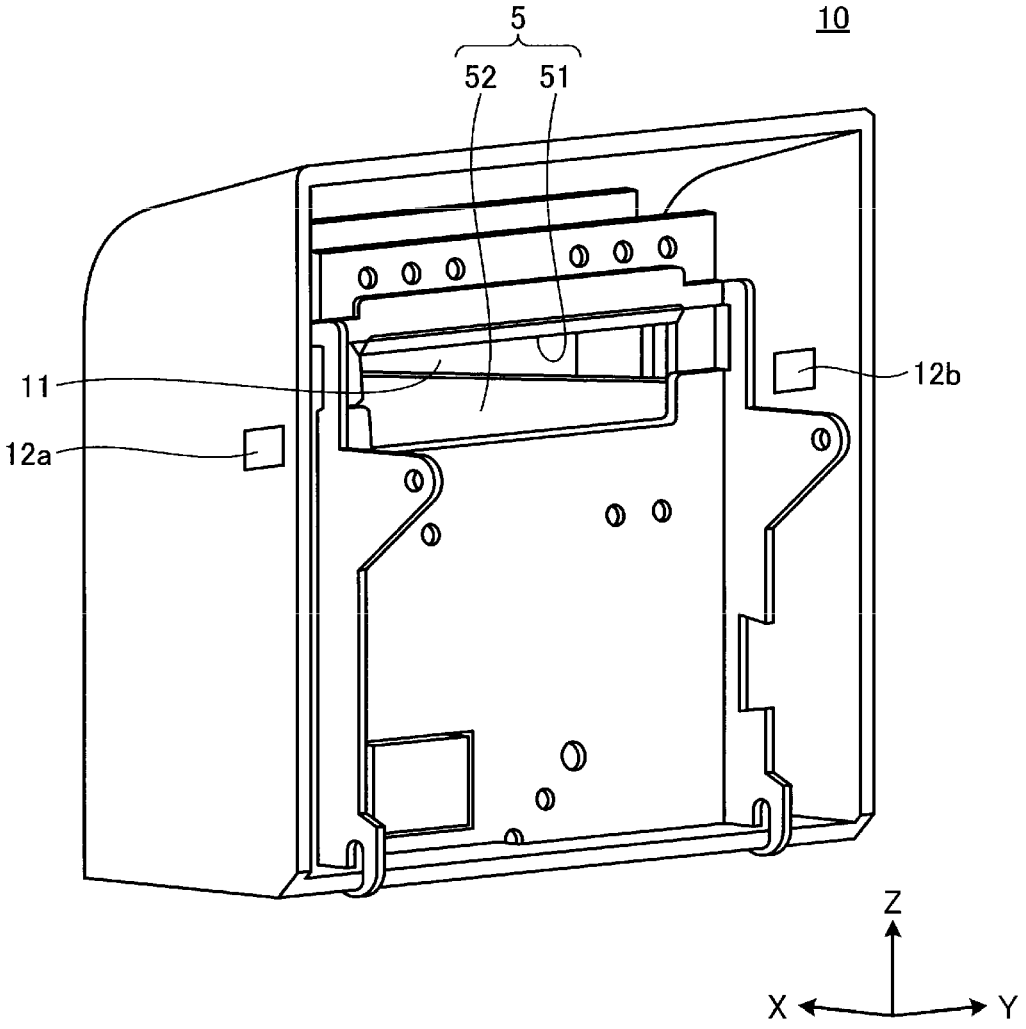
FIG. 2 is a perspective diagram illustrating an example of a cutting device.

Next, the cutting device 10 will be described. The cutting device 10 cuts off a portion of the linerless label L on which the label information is printed by the thermal head 22 of the printing device 20 and thus creates a piece of label. FIG. 2 is a perspective diagram illustrating an example of the cutting device. The cutting device 10 illustrated in FIG. 2 is in a state detached from the label printer 100.

As illustrated in FIG. 2, the cutting device 10 is provided with a cutting unit 5 having a fixed blade 51, a movable blade 52, and a driving mechanism (not illustrated), and mounting holes 12*a* and 12*b* as an example of a mounting mechanism. The cutting unit 5 cuts the linerless label L after being printed by the printing device 20.

The fixed blade 51 cuts the linerless label L from the print surface in a state fixed to the cutting device 10. In the present embodiment, the upper portion of the fixed blade 51 is fixed to the cutting device 10, and the cutting edge of the fixed blade 51 faces downward and cuts the linerless label L transported therebelow in collaboration with the movable blade 52.

The movable blade 52 moves in the vertical direction, that is, in the Z-axis direction, slides past the fixed blade 51 to apply shearing force to the linerless label L, and cuts a portion of the linerless label L from the rear surface having the adhesive material. In the present embodiment, the cutting edge of the movable blade 52 faces upward and cuts the linerless label L transported thereabove.

Figure 3:
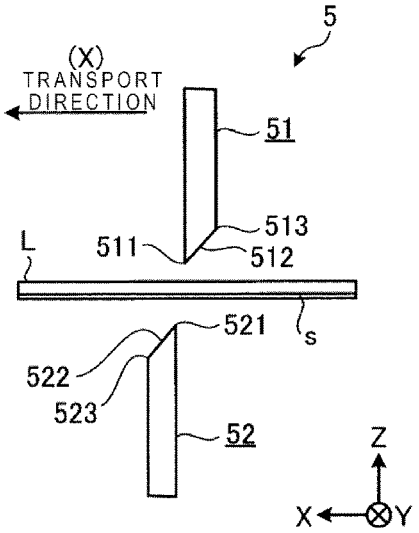
FIG. 3 is a diagram illustrating a configuration of a cutting unit.

Here, details of the cutting unit 5 will be described. FIG. 3 is a diagram showing the configuration of the cutting unit. In FIG. 3, the cutting unit 5 is viewed from the Y-axis direction (see FIG. 1).

The fixed blade 51 has a cutting blade 512, and a cutting edge 511 thereof faces the print surface side of the linerless label L. The cutting blade 512 gradually becomes thin from a cutting edge start line 513 of the fixed blade 51 to the cutting edge 511. The fixed blade 51 is a single blade having an inclined surface of the cutting blade 512 only on the upstream side of the linerless label L in the transport direction.

The movable blade 52 is positioned on downstream side of the fixed blade 51 in the transport direction (X-axis direction). The movable blade 52 has a cutting blade 522, and a cutting edge 521 is facing the pasting surface (rear surface with adhesive material) side of the linerless label L. The cutting blade 522 gradually becomes thinner from a cutting edge start line 523 of the movable blade 52 to the cutting edge 521. The movable blade 52 is a single blade having an inclined surface of the cutting blade 522 only on the downstream side of the linerless label L in the transport direction.

Upon cutting the linerless label L, the driving mechanism moves the movable blade 52 in the vertical direction (Z-axis direction) so as to slide past the fixed blade 51 by a driving force of a motor or the like. As a result, the fixed blade 51 and the movable blade 52 apply a shearing force to cut the linerless label L, and a portion of the linerless label L, which is cut off, is transported to the outside through the discharge port 11 (see FIG. 2).

Here, as described above, the movable blade 52 cuts the linerless label L from the pasting surface side of the linerless label L having the adhesive material. Therefore, the adhesive material of the linerless label L adheres to a vicinity of the cutting edge 521 of the contact surface, which is a surface abuts the fixed blade 51 when cutting the linerless label L.

Figure 4A:
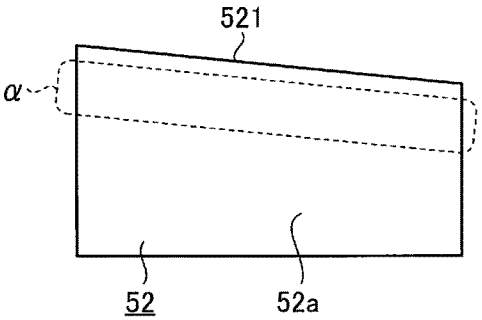
FIGS. 4A and 4B are diagrams illustrating an example of an region of a movable blade on which an adhesive material adheres.
Figure 4B:
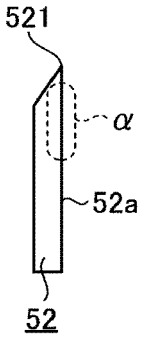

FIGS. 4A and 4B are diagrams illustrating an example of a region of the movable blade on which an adhesive material adheres. FIG. 4A is a diagram of the movable blade 52 as viewed from the X-axis direction, and FIG. 4B is a diagram of the movable blade 52 as viewed from the Y-axis direction (see FIG. 3).

As illustrated in FIGS. 4A and 4B, the cutting edge 521 of the movable blade 52 is inclined with respect to the horizontal plane. Accordingly, the cutting unit 5 cuts from the one end portion toward the other end portion of the transported linerless label L. In the present embodiment, in the case of facing the transport direction (X direction), the linerless label L is cut from the left end portion toward the right end portion.

In the movable blade 52, the adhesive material of the linerless label L adheres around a region α, which is formed in parallel to the cutting edge 521 (side of the tip end portion) of the movable blade 52 on the contact surface 52*a*, which abuts the fixed blade 51 when cutting the linerless label L. On the other hand, the adhesive material hardly adheres to the cutting edge 521

Returning to FIG. 2, the mounting holes 12*a* and 12*b* are formed on the side surface of a casing of the cutting device 10 in order to attach a cleaning tool for removing the adhesive material adhered to the movable blade 52 and cleaning the movable blade 52. The mounting holes 12*a* and 12*b* of the present embodiment are formed in a square shape, for example.

Figure 5:
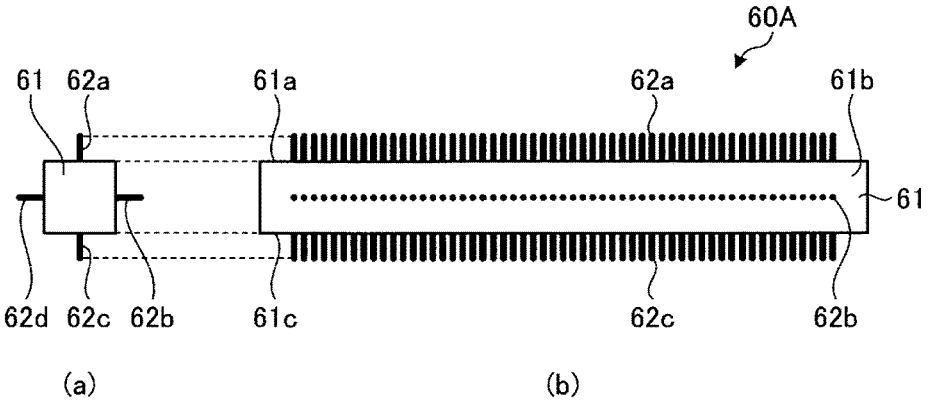
FIG. 5 is a diagram illustrating an example of a cleaning tool.
Figure 6:
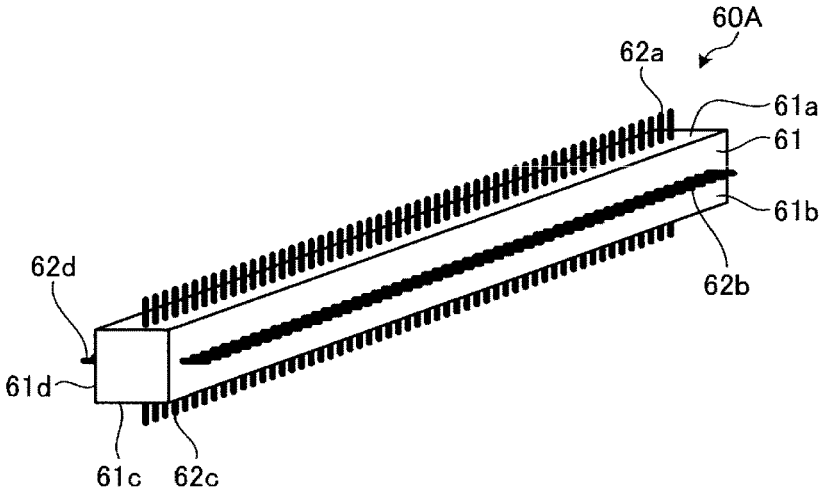
FIG. 6 is a perspective diagram of the cleaning tool.

Here, the cleaning tool will be explained. FIG. 5 is a diagram illustrating an example of the cleaning tool. FIG. 5(*b*) is a front diagram of a cleaning tool 60A, and FIG. 5(*a*) is a side diagram of the cleaning tool 60A. FIG. 6 is a perspective diagram of the cleaning tool illustrated in FIG. 5.

As illustrated in FIGS. 5 and 6, the cleaning tool 60A includes brushes 62*a*, 62*b*, 62*c*, and 62*d* arranged respectively on four flat surfaces 61*a*, 61*b*, 61*c*, and 61*d* of a polygonal rod 61 having a square prism shape, such that each of the brushes extends outwardly in a direction (upper, lower, left and right directions) orthogonal to the four flat surfaces 61*a*, 61*b*, 61*c*, and 61*d*. In addition, the brushes 62*a* to 62*d* are provided near the center of the flat surfaces 61*a* to 61*d* in a lateral direction that is parallel a longitudinal direction of the polygonal rod 61. The brushes 62*a* to 62*d* are for removing the adhesive material adhered to the movable blade 52, and the materials thereof are not limited to the example described in the present embodiment. The material is formed of, for example, a resin or the like. The brush is an example of the removing portion.

Both end portions of the polygonal rod 61 in the longitudinal direction of the cleaning tool 60A are inserted into the mounting holes 12*a* and 12*b* of the cutting device 10 (see FIGS. 2, 5, and 6). As a mounting method, for example, the cleaning tool 60A is mounted by being inserted into the mounting hole 12*a* from the outside of the side surface provided with the mounting hole 12*a*, and inserted into the mounting hole 12*b* through the inside of the cutting device 10 to be exposed to the outside. The cleaning tool 60A may be mounted by being inserted from the mounting hole 12*b* side. As another mounting method, the cleaning tool 60A is mounted by inserting both end portions of the cleaning tool 60A into the mounting holes 12*a* and 12*b* from the inside of the cutting device 10, respectively, to be exposed to the outside.

Figure 7A:
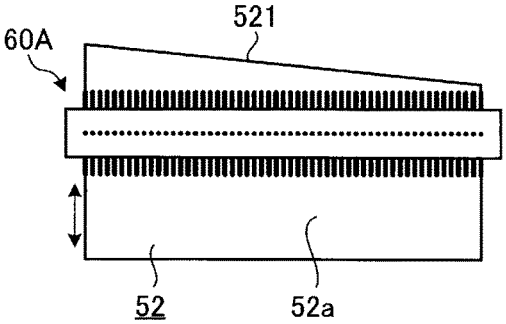
FIGS. 7A and 7B are diagrams explaining a position of the cleaning tool with respect to the movable blade.
Figure 7B:
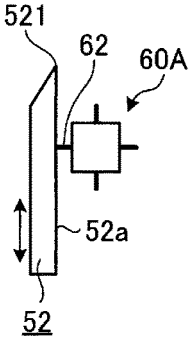

In order to remove the adhesive material adhered onto the contact surface 52*a* of the movable blade 52 by the cleaning tool 60A mounted on the cutting device 10, it is necessary to mount the cleaning tool 60A at a predetermined position. FIGS. 7A and 7B are diagrams explaining a position of the cleaning tool with respect to the movable blade. FIG. 7A is a diagram of the movable blade 52 as viewed from the X-axis direction, and FIG. 7B is a diagram of the movable blade 52 as viewed from the Y-axis direction. Regarding the X axis and the Y axis, reference is made to FIG. 1 and the like.

As illustrated in FIGS. 7A and 7B, the mounting holes 12*a* and 12*b* allow the cleaning tool 60A to be mounted at a position where one of the brushes 62*a* to 62*d* comes into contact with the contact surface 52*a* of the movable blade 52 on which the fixed blade 51 abuts when cutting the linerless label L. When referring to any one of the brushes 62*a* to 62*d* herein, the brush 62*a*, 62*b*, 62*c*, or 62*d* may be simply referred to as a brush 62.

Further, in the present embodiment, the end portions of the polygonal rod 61 having a square shape in cross section are inserted into the square mounting holes 12*a* and 12*b* of the cutting device 10, respectively, to mount the cleaning tool 60A. Therefore, the mounting holes 12*a* and 12*b* regulate the mounted cleaning tool 60A so as not to rotate.

In addition, there are cases where the brushes 62*a* to 62*d* are cut when the brushes 62*a* to 62*d* come into contact with the cutting edge 521 of the movable blade 52. Therefore, the mounting holes 12*a* and 12*b* are positioned to allow the cleaning tool 60A to be mounted at the position where the brushes 62*a* to 62*d* do not come into contact with the cutting edge 521, that is the tip end portion of the movable blade 52, even if the movable blade 52 moves back to its lowest position. In the cutting device 10 of the present embodiment, even in a case where the cleaning tool 60A is mounted horizontally (along the Y-axis direction) and the movable blade 52 is located at the lowest position, the cleaning tool 60A is mounted at the position where the brush 62 is still below the cutting edge 521 and thus does not come into contact with the cutting edge 521.

As described above, in the cutting device 10 of the label printer 100 according to the present embodiment, by simply mounting the cleaning tool 60A and moving the movable blade 52 in the vertical direction (Z-axis direction) when cutting the linerless label L, the brush 62 in contact with the contact surface 52*a* of the movable blade 52 removes the adhesive material adhered onto the contact surface 52*a* of the movable blade 52 and cleans the movable blade 52. Therefore, it is possible to easily clean the movable blade 52 for cutting the linerless label L, and suppress an increase in electric power used at the time of cutting the next linerless label L.

Further, since the brushes 62*a* to 62*d* are provided on the flat surfaces 61*a* to 61*d* of the polygonal rod 61, respectively, the cleaning tool 60A can use the four brushes 62*a* to 62*d* for cleaning the movable blade 52. Accordingly, even if the first brush 62 is used up due to abrasion or the like, user can change the brush to be used for the cleaning of the movable blade 52 by rotating the cleaning tool 60A to a desired position (for example, by rotating 90 degrees in the present embodiment) before being mounted on the cutting device 10. Thereby, it is possible to use four brushes in turn, so that the replacement frequency of the cleaning tool 60A can be reduced.

Modification Example of First Embodiment

In the label printer 100 of the first embodiment, the cleaning tool 60A is mounted horizontally (parallel to the Y axis) in the cutting device 10. However, in the present modification example, the cleaning tool 60A is mounted so that the brush 62 is parallel to the cutting edge 521 of the movable blade 52.

Figure 8A:
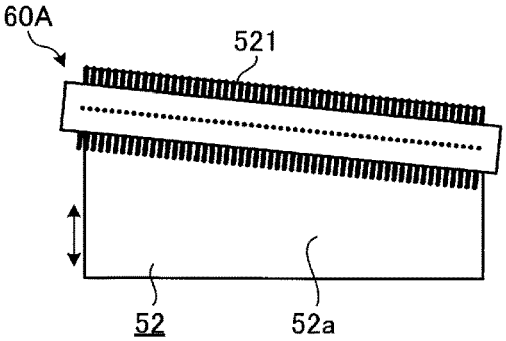
FIGS. 8A and 8B are diagrams explaining the position of the cleaning tool with respect to the movable blade.
Figure 8B:
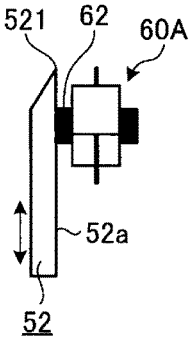

FIGS. 8A and 8B are diagrams explaining the position of the cleaning tool with respect to the movable blade. FIG. 8A is a diagram of the movable blade 52 as viewed from the X-axis direction, and FIG. 8B is a diagram of the movable blade 52 as viewed from the Y-axis direction. Regarding the X axis and the Y axis, reference is made to FIG. 1 and the like.

Similarly to the first embodiment, the cutting device 10 of the present modification example mounts the cleaning tool 60A at a position where the brush 62 comes into contact with the contact surface 52*a* of the movable blade 52 as illustrated in FIGS. 8A and 8B. Further, in the cutting device 10 of the present modification example, even when the movable blade 52 moves, the cleaning tool 60A is mounted at a position where the brush 62 does not come into contact with the cutting edge 521 which is the tip end portion of the movable blade 52. In the cutting device 10 of the present modification example, the cleaning tool 60A is mounted so that the arrangement direction of the brush 62 is parallel to the cutting edge 521 of the movable blade 52.

In addition, similarly to the first embodiment, in the cutting device 10 of the present modification example, the cleaning tool 60A is mounted by inserting both ends of the polygonal rod 61 into the mounting holes 12*a* and 12*b*. Therefore, the mounting holes 12*a* and 12*b* regulate the mounted cleaning tool 60A so as not to rotate.

As described above, in the cutting device 10 of the label printer 100 of the present modification example, by simply mounting the cleaning tool 60A and moving the movable blade 52 in the vertical direction (Z-axis direction) when cutting the linerless label L, the brush 62 in contact with the contact surface 52*a* of the movable blade 52 removes the adhesive material adhered onto the contact surface 52*a* of the movable blade 52 and cleans the movable blade 52. Therefore, it is possible to easily clean the movable blade 52 for cutting the linerless label L, and to suppress an increase in electric power used at the time of cutting the next linerless label L.

In addition, in the cutting device 10 of this modification example, since the cleaning tool 60A is mounted such that the arrangement direction of the brush 62 is parallel to the side of the cutting edge 521 which is the tip end portion of the movable blade 52, it is possible to clean up to the vicinity of the cutting edge 521 of the movable blade 52, and more adhesive material can be removed.

Similarly to the first embodiment, the cleaning tool 60A rotates at a desired angle about the polygonal rod 61 as an axis before being mounted on the cutting device 10 to be mounted even when the first brush 62 is used up due to abrasion or the like. Thereby, it is possible to use four brushes (removing portions) in turn, so that the replacement frequency of the cleaning tool 60A can be reduced.

Second Embodiment

In the label printer 100 of the first embodiment, the cleaning tool 60A in which the brush 62 is provided in parallel with the longitudinal direction of the polygonal rod 61 is mounted on the cutting device 10. On the other hand, in the present embodiment, a cleaning tool provided with a brush inclined with respect to the longitudinal direction of the polygonal rod is mounted. The configuration of the label printer is the same as that of the first embodiment.

Figure 9:
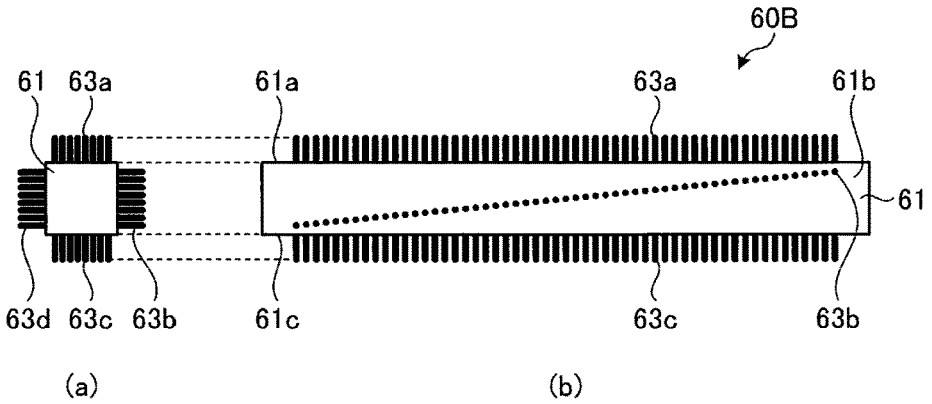
FIG. 9 is a diagram illustrating an example of a cleaning tool.
Figure 10:
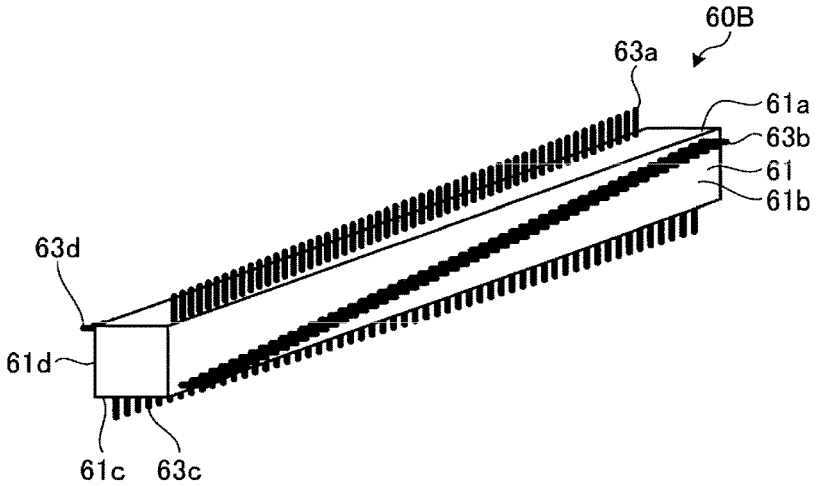
FIG. 10 is a perspective diagram of the cleaning tool.

FIG. 9 is a diagram illustrating an example of a cleaning tool. FIG. 9(*b*) is a front diagram of the cleaning tool 60B, and FIG. 9(*a*) is a side diagram of the cleaning tool 60B. FIG. 10 is a perspective diagram of the cleaning tool illustrated in FIG. 9.

As illustrated in FIGS. 9 and 10, the cleaning tool 60B includes brushes 63*a*, 63*b*, 63*c*, and 63*d* arranged on four flat surfaces 61*a*, 61*b*, 61*c*, and 61*d* of the polygonal rod 61, such that each of the brush extends outwardly in a direction (upper, lower, left and right directions) orthogonal to four flat surfaces 61*a*, 61*b*, 61*c*, and 61*d*. In addition, the brushes 63*a* to 63*d* are provided such that those arrangement direction are inclined with respect to the longitudinal direction of the flat surfaces 61*a* to 61*d*. In the present embodiment, for example, the inclination angle of the arrangement direction of the brushes 63*a* to 63*d* with respect to the longitudinal direction is the same as the angle of the cutting edge 521 of the movable blade 52 with respect to the horizontal direction.

The materials of the brushes 63*a* to 63*d* are the same as those of the first embodiment, and the brush is an example of the removing portion. Also, the mounting method of the cleaning tool 60B is the same as in the first embodiment.

Figure 11A:
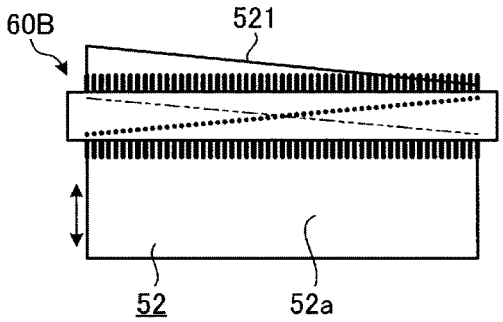
FIGS. 11A and 11B are diagrams explaining the position of the cleaning tool with respect to the movable blade.
Figure 11B:
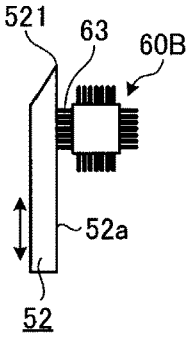

In order to remove the adhesive material adhered onto the contact surface 52*a* of the movable blade 52 by the cleaning tool 60B mounted on the cutting device 10, it is necessary to mount the cleaning tool 60B at a predetermined position. FIGS. 11A and 11B are diagrams explaining the position of the cleaning tool with respect to the movable blade. FIG. 11A is a diagram of the movable blade 52 as viewed from the X-axis direction, and FIG. 11B is a diagram of the movable blade 52 as viewed from the Y-axis direction. Regarding the X axis and the Y axis, reference is made to FIG. 1 and the like.

As illustrated in FIGS. 11A and 11B, the mounting holes 12*a* and 12*b* allow the cleaning tool 60B to be mounted at a position where one of the brushes 63*a* to 63*d* comes into contact with the contact surface 52*a* of the movable blade 52 on which the fixed blade 51 abuts when cutting the linerless label L. In a case of indicating any one of the brushes 63*a* to 63*d*, the brush may be simply referred to as a brush 63.

In the cutting device 10 of the present embodiment, similarly to the first embodiment, the cleaning tool 60B is mounted by inserting the end portions of the polygonal rod 61 into the mounting holes 12*a* and 12*b*. Therefore, the mounting holes 12*a* and 12*b* regulate the mounted cleaning tool 60B so as not to rotate.

In addition, since there are cases where the brushes 63*a* to 63*d* come into contact with the cutting edge 521 of the movable blade 52 and are cut, the mounting holes 12*a* and 12*b* allow the cleaning tool 60B to be mounted at a position where the brushes 63*a* to 63*d* does not come into contact with the cutting edge 521 which is the tip end portion of the movable blade 52 even when the movable blade 52 moves. In the cutting device 10 of the present embodiment, the cleaning tool 60B is mounted horizontally (along the Y-axis direction). As described above, the inclination angle of the arrangement direction of the brushes 63*a* to 63*d* with respect to the longitudinal direction of the polygonal rod 61 is the same as the angle of the cutting edge 521 of the movable blade 52 with respect to the horizontal direction. Therefore, in the cutting device 10, when the cleaning tool 60B is mounted horizontally, the brush 63 is mounted so that the arrangement direction of the brush 63 is parallel to the side of the cutting edge 521 of the movable blade 52. In FIG. 11A, the brush 63 that comes into contact with the contact surface 52*a* of the movable blade 52 is indicated by a two-dot chain line.

As described above, in the cutting device 10 of the label printer 100 according to the present embodiment, by simply mounting the cleaning tool 60B and moving the movable blade 52 in the vertical direction (Z-axis direction) when cutting the linerless label L, the brush 63 in contact with the contact surface 52*a* of the movable blade 52 removes the adhesive material adhered onto the contact surface 52*a* of the movable blade 52 and cleans the movable blade 52. Therefore, it is possible to easily clean the contact surface 52*a* of the movable blade 52 for cutting the linerless label L, and suppress an increase in electric power used at the time of cutting the next linerless label L.

Similarly to the first embodiment, the cleaning tool 60B rotates at a desired angle about the polygonal rod 61 as an axis before being mounted on the cutting device 10 to be mounted even when the first brush 63 is used up due to abrasion or the like, and the four brushes (removing portions) can be used in turn, so that the replacement frequency of the cleaning tool 60B can be reduced.

Further, in the cutting device 10 of the present embodiment, since the cleaning tool 60B is mounted such that the arrangement direction of the brush 63 is parallel to the side of the cutting edge 521 which is the tip end portion of the movable blade 52, it is possible to clean up to the vicinity of the cutting edge 521 of the movable blade 52, and more adhesive material can be removed.

Third Embodiment

In the label printer 100 of the first embodiment, the cutting edge 521 of the movable blade 52 provided in the cutting device 10 is inclined from one end portion to the other end portion with respect to the horizontal direction. On the other hand, in the present embodiment, the cutting edge of the movable blade is symmetrically inclined from both end portions to the center. The configuration of the label printer is the same as that of the first embodiment.

Figure 12A:
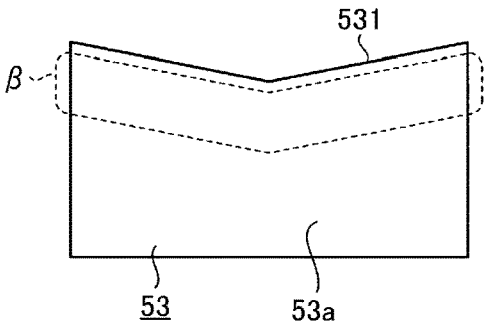
FIGS. 12A and 12B are diagrams illustrating an example of the region of a movable blade on which an adhesive material adheres.
Figure 12B:
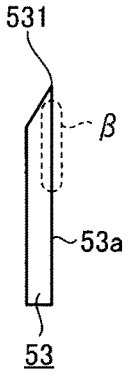

FIGS. 12A and 12B are diagrams illustrating an example of the region of a movable blade on which an adhesive material adheres. FIG. 12A is a diagram of the movable blade 53 as viewed from the X-axis direction, and FIG. 12B is a diagram of the movable blade 53 as viewed from the Y-axis direction. Regarding the X axis and the Y axis, reference is made to FIG. 1 and the like.

As illustrated in FIGS. 12A and 12B, the cutting edge 531 of the movable blade 53 is symmetrically inclined from both end portions to the center. Accordingly, the cutting unit 5 cuts from the both end portions of the transported linerless label L toward the center. Then, the adhesive material of the linerless label L adheres around a region β parallel to the cutting edge 531 (i.e., side of the tip end portion) on the contact surface 53*a* of the movable blade 53, on which the fixed blade 51 abuts when cutting the linerless label L. Since the cutting edge 531 cuts the linerless label L, the adhesive material hardly adheres.

Figure 13:
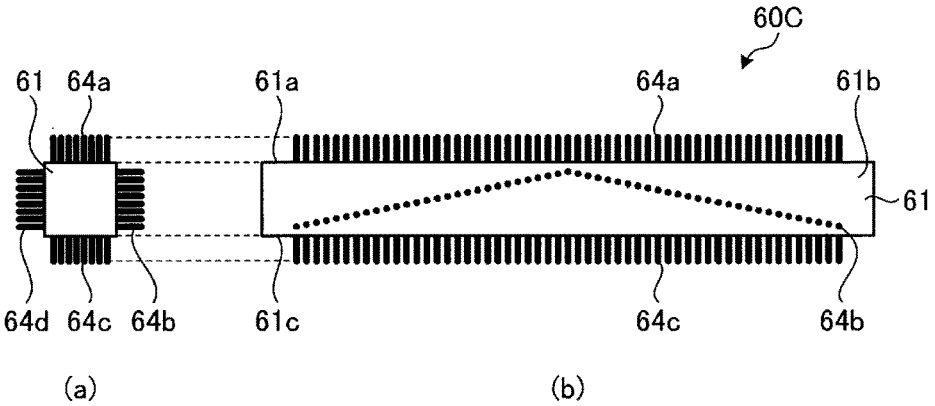
FIG. 13 is a diagram illustrating an example of a cleaning tool.
Figure 14:
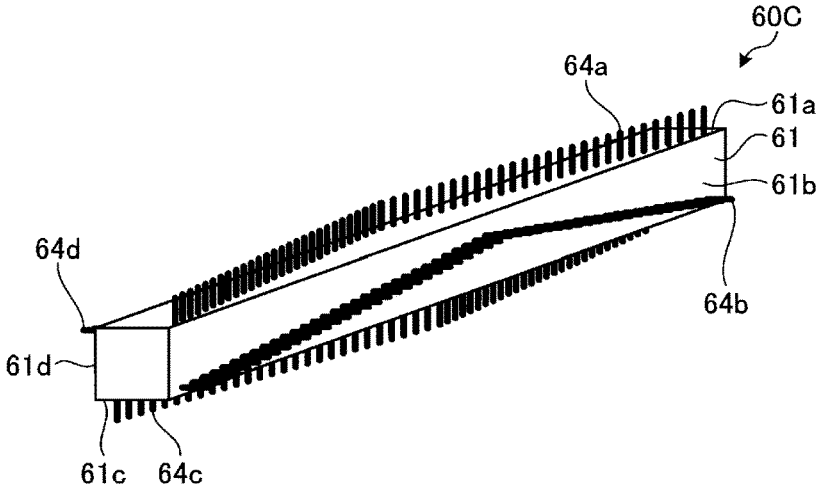
FIG. 14 is a perspective diagram of the cleaning tool.

Next, the cleaning tool of the present embodiment will be described. FIG. 13 is a diagram illustrating an example of a cleaning tool. FIG. 13(*b*) is a front diagram of a cleaning tool 60C, and FIG. 13(*a*) is a side diagram of the cleaning tool 60C. FIG. 14 is a perspective diagram of the cleaning tool illustrated in FIG. 13.

As illustrated in FIGS. 13 and 14, the cleaning tool 60C is provided with brushes 64*a*, 64*b*, 64*c*, and 64*d* in a direction (the upper, lower, left and right directions)

orthogonal to four flat surfaces 61*a*, 61*b*, 61*c*, and 61*d* including a longitudinal side of a polygonal rod 61 about the polygonal rod 61 having a square prism shape as an axis, respectively. In addition, the brushes 64*a* to 64*d* are provided so as to be inclined in a V shape with respect to the longitudinal direction of the flat surfaces 61*a* to 61*d*. In the present embodiment, for example, the inclination angle of the V shape with respect to the arrangement direction of the brushes 64*a* to 64*d* is the same as the angle of the cutting edge 531 of the movable blade 53 with respect to the horizontal direction.

The materials of the brushes 64*a* to 64*d* are the same as those of the first embodiment, and the brush is an example of a removing portion. The mounting method of the cleaning tool 60C is also the same as in the first embodiment.

Figure 15A:
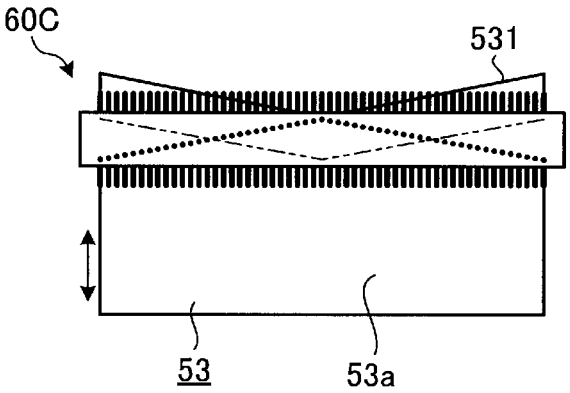
FIGS. 15A and 15B are diagrams explaining a position of the cleaning tool with respect to the movable blade.
Figure 15B:
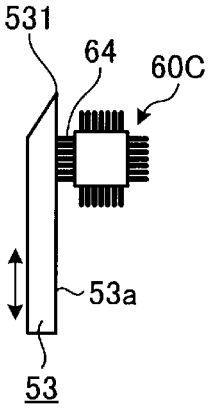

In order to remove the adhesive material adhered to the movable blade 53 by the cleaning tool 60C mounted on the cutting device 10, it is necessary to mount the cleaning tool 60C at a predetermined position. FIGS. 15A and 15B are diagrams explaining a position of the cleaning tool with respect to the movable blade. FIG. 15A is a diagram of the movable blade 53 as viewed from the X-axis direction, and FIG. 15B is a diagram of the movable blade 53 as viewed from the Y-axis direction. Regarding the X axis and the Y axis, reference is made to FIG. 1 and the like.

As illustrated in FIGS. 15A and 15B, the mounting holes 12*a* and 12*b* allow the cleaning tool 60C to be mounted at a position where one of the brushes 64*a* to 64*d* comes into contact with the contact surface 53*a* of the movable blade 53 on which the fixed blade 51 abuts when cutting the linerless label L. In the case of indicating any one of the brushes 64*a* to 64*d*, the brush 64 may be simply referred to as a brush 64.

In the cutting device 10 of the present embodiment, similarly to the first embodiment, the cleaning tool 60C is mounted by inserting the end portions of the polygonal rod 61 into the mounting holes 12*a* and 12*b*. Therefore, the mounting holes 12*a* and 12*b* regulate the mounted cleaning tool 60C so as not to rotate.

In addition, since there are cases where the brushes 64*a* to 64*d* come into contact with the cutting edge 531 of the movable blade 53 and cut, the mounting holes 12*a* and 12*b* allow the cleaning tool 60C to be mounted at a position where the brushes 64*a* to 64*d* do not come into contact with the cutting edge 531 which is the tip end portion of the movable blade 53 even when the movable blade 53 moves. In the cutting device 10 of the present embodiment, the cleaning tool 60C is mounted horizontally (along the Y-axis direction). Further, as described above, since the inclination angle of the V shape of the brushes 64*a* to 64*d* with respect to the longitudinal direction of the polygonal rod 61 is the same as the angle of the cutting edge 531 of the movable blade 53 with respect to the horizontal direction. Therefore in the cutting device 10, when the cleaning tool 60C is mounted horizontally, the brush 64 is mounted so that the longitudinal direction thereof is parallel to the side of the cutting edge 531 of the movable blade 53. In FIG. 15A, the brush 64 comes into contact with the contact surface 53*a* of the movable blade 53 is indicated by a two-dot chain line.

As described above, in the cutting device 10 of the label printer 100 according to the present embodiment, by simply mounting the cleaning tool 60C and moving the movable blade 53 in the vertical direction (Z-axis direction) when cutting the linerless label L, the brush 64 in contact with the contact surface 53*a* of the movable blade 53 on which the fixed blade 51 abuts when cutting the linerless label L removes the adhesive material adhered onto the contact surface 53*a* of the movable blade 53 and cleans the movable blade 53. Therefore, it is possible to easily clean the movable blade 53 for cutting the linerless label L, and suppress an increase in electric power used at the time of cutting the next linerless label L.

Similarly to the first embodiment, the cleaning tool 60C is rotated at a desired angle about the polygonal rod 61 as an axis and then mounted on the cutting device 10 so that, even when the first brush 64 is used up due to abrasion or the like, it is possible to use four brushes (removing portions) in turn, and therefore the replacement frequency of the cleaning tool 60C can be reduced.

Further, in the cutting device 10 of the present embodiment, since the cleaning tool 60C is mounted such that the brush 64 is parallel to the side of the cutting edge 531 which is the tip end portion of the movable blade 53, it is possible to clean up the vicinity of the cutting edge 531 of the movable blade 53 and to remove more adhesive material.

In the above-described embodiment, the fixed blade is provided on the upper side, the movable blade is provided on the lower side, and the linerless label L is cut by moving the movable blade in the vertical direction. However, the movable blade may be provided on the upper side and the fixed blade may be provided on the lower side. In this case, if the movable blade is provided on the upstream side of the fixed blade in the transport direction, the surface of the movable blade on which the fixed blade abuts becomes the downstream surface. Even if the adhesive material adheres to the movable blade, since the adhesive material cannot be removed by the cleaning tool (brush) mounted on the upstream side of the movable blade, it is preferable that the movable blade is located on downstream side of the fixed blade in the transport direction.

Further, although the cleaning tool of the present embodiment is configured to have four brushes from a polygonal rod having a square prism shape, the shape of the polygonal rod and the number of brushes can be changed arbitrary. Accordingly, the cleaning tool may be provided with three brushes in a triangular prism shape or five brushes from a polygonal rod having a pentagonal prism shaped. In that case, the mounting holes of the cutting device are formed in the cross-sectional shape (triangle, pentagon, and the like) of the polygonal rod of those cleaning tools.

Further, the cleaning tool of the present embodiment removes the adhesive material adhered to the movable blade to clean. Accordingly, the adhesive material adhered to the fixed blade can be removed by manually inserting a cleaning tool, a cotton swab or the like from a discharge port or the like. In addition, in the case of manually removing the adhesive material adhered to the movable blade to clean, the brush of the cleaning tool may be provided in a spiral shape on the polygonal rod.

The cutting device of the present embodiment can be applied not only to cutting a linerless label used in a label printer but also to a case of cutting a pastable member having an adhesive material by an amount corresponding to use, for example, a cellophane tape, a gummed tape, or the like.

In the above-described embodiment, the adhesive material of the linerless label L is removed by the brush, but the present invention is not limited to this, and a cleaning tool having another removing portion may be used. For example, the adhesive material may be removed by a plate-like spatula or the like.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A cutting device comprising:

a fixed blade and a movable blade that slides past the fixed blade during cutting; and a cleaning tool with an adhesive removing element that comes into contact with a surface of the movable blade that faces the fixed blade during the cutting.

2. The device according to claim 1, further comprising:

a frame to which the cleaning tool is mounted, wherein the cleaning tool is mounted to the frame so as to prevent rotation of the cleaning tool during the cutting.

3. The device according to claim 2, wherein the frame has an opening and a longitudinal end of the cleaning tool is inserted into and engaged with the opening so that the cleaning tool does not rotate while engaged with the opening.

4. The device according to claim 3, wherein the opening is square-shaped and the longitudinal end of the cleaning tool has a square shape.

5. The device according to claim 4, wherein the cleaning tool includes a square-shaped rod with four longitudinal surfaces and the adhesive removing element is installed on at least a first one of the four longitudinal surfaces.

6. The device according to claim 5, wherein the adhesive removing element includes a plurality of brushes that extend outwardly from the first one of the longitudinal surfaces.

7. The device according to claim 6, wherein the brushes are arranged along a straight horizontal line.

8. The device according to claim 6, wherein the brushes are arranged along a straight line that is inclined with respect to a horizontal line and parallel to at least one cutting edge of the movable blade.

9. The device according to claim 6, wherein the brushes are arranged along two straight lines that are inclined with respect to a horizontal line.

10. The device according to claim 9, wherein the two straight lines do not cross.

11. The device according to claim 9, wherein the two straight lines cross each other.

12. The device according to claim 1, wherein the movable blade has a lower limit position and the adhesive removing element is at a fixed position that is below a cutting edge of the movable blade when the movable blade is at the lower limit position.

13. A label printer comprising:

a roll of label having a first side for printing and a second side with an adhesive;

a printing device configured to perform printing on the first side of the label supplied from the roll; and a cutting device configured to cut the label supplied from the roll, wherein the cutting device includes a fixed blade and a movable blade that slides past the fixed blade during cutting, and a cleaning tool with an adhesive removing element that comes into contact with a surface of the movable blade that faces the fixed blade during the cutting.

14. The label printer according to claim 13, further comprising:

a frame to which the cleaning tool is mounted, wherein the cleaning tool is mounted to the frame so as to prevent rotation of the cleaning tool during the cutting.

15. The label printer according to claim 14, wherein the frame has an opening and a longitudinal end of the cleaning tool is inserted into and engaged with the opening so that the cleaning tool does not rotate while engaged with the opening.

16. The label printer according to claim 15, wherein the opening is square-shaped and the longitudinal end of the cleaning tool has a square shape.

17. The label printer according to claim 16, wherein the cleaning tool includes a square-shaped rod with four longitudinal surfaces and the adhesive removing element is installed on at least a first one of the four longitudinal surfaces.

18. The label printer according to claim 17, wherein the adhesive removing element includes a plurality of brushes that extend outwardly from the first one of the longitudinal surfaces.

19. The label printer according to claim 18, wherein the brushes are arranged along a straight line.

20. The label printer according to claim 13, wherein the movable blade has a lower limit position and the adhesive removing element is at a fixed position that is below a cutting edge of the movable blade when the movable blade is at the lower limit position.

* * * * *